United States Patent [19]

McRoskey et al.

[11] 4,120,427

[45] Oct. 17, 1978

[54] POWDER GUN

[75] Inventors: John W. McRoskey; Leonard H. McRoskey, both of Los Angeles; Delbert D. Swartz, Torrance, all of Calif.

[73] Assignee: Republic Tool & Manufacturing Corp., Los Angeles, Calif.

[21] Appl. No.: 755,219

[22] Filed: Dec. 29, 1976

[51] Int. Cl.[2] ..... B05B 11/04

[52] U.S. Cl. ..... 222/193; 222/209; 239/363

[58] Field of Search ..... 222/193, 209, 401; 239/362, 363

[56] References Cited

U.S. PATENT DOCUMENTS

| | | | |
|---|---|---|---|
| 2,148,711 | 2/1939 | Reeve | 222/193 X |
| 2,549,977 | 4/1951 | Kundtz et al. | 222/193 |
| 3,904,087 | 9/1975 | McRoskey et al. | 222/193 |

*Primary Examiner*—Robert B. Reeves
*Assistant Examiner*—Francis J. Bartuska
*Attorney, Agent, or Firm*—Whann & McManigal

[57] ABSTRACT

A powder dispersing device having an open ended container adapted to contain a powder, a diaphragm movable toward and away from the open end of the container whereby the powder is agitated and air is caused to flow into an annular outlet passage, there being venturi openings between the interior of the container and the outlet passage whereby the powder is sucked into the outlet passage and caused to flow outwardly therefrom in the form of a powder-in-air dispersion.

8 Claims, 4 Drawing Figures

POWDER GUN

BACKGROUND OF THE INVENTION

It is common practice to spray and dust plants to kill insects, bugs, etc., and numerous types of powder and liquid dispersing devices are in common use. A device for spraying liquid in air wholly unsuited for powder has cylinder and piston arrangement in combination with a reservoir positioned on one side of the pump which pumps a stream of air which draws liquid to be dispersed into the pump cylinder thereof and disperses liquid and air mixture. This type of apparatus has many disadvantages. Also the inventors of U.S. Pat. to McRoskey, et al. No. 3,904,087, issued Sept. 9, 1976, entitled Compartmented Powder Dispersing Device, have devised the structure shown therein for dispersing powder.

SUMMARY OF THE INVENTION

It is an object of the present invention to improve upon the structure of this prior art patent and this is accomplished by a substantially different arrangement of parts which will be fully described and disclosed herein.

It is an object of the invention to provide a powder dispersing device in which there is a container having an open end, a body removably attached to said container having a movable wall, handle and lever means whereby the movable wall can be actuated to blow air from the container, cause it to pick up powder and deliver it in an air and powder dispersion.

It is an object of the invention to provide an arrangement whereby when the powder is used up the body and the container are separated and the empty container is replaced by another container containing a new supply of powder.

It is an object of the invention to provide a powder dispersing device in the form of a can which is normally nondeformable and in which the combination has a movable wall closing the end of the can, which movable wall is conveniently actuated by a handle and lever arrangement whereby the structure can be held in one hand and actuated by a squeezing action which moves the operating lever relative to the handle.

Sometimes parts having small opening means, as is the case in the present invention, require cleaning, and it is an object of this invention to provide an arrangement in which the parts can be readily disassembled, cleaned and reassembled.

It is a still further object of the invention to provide a body structure to be used in conjunction with the normally non-deformable can, the body structure containing all of the operating parts so that the can which is the container for the powder can be a standard type of can.

Other objects and advantages of the invention will be made evident in the course of the following detailed description of a preferred form of the invention.

DESCRIPTION OF THE PREFERRED EMBODIMENT

Figure 1:
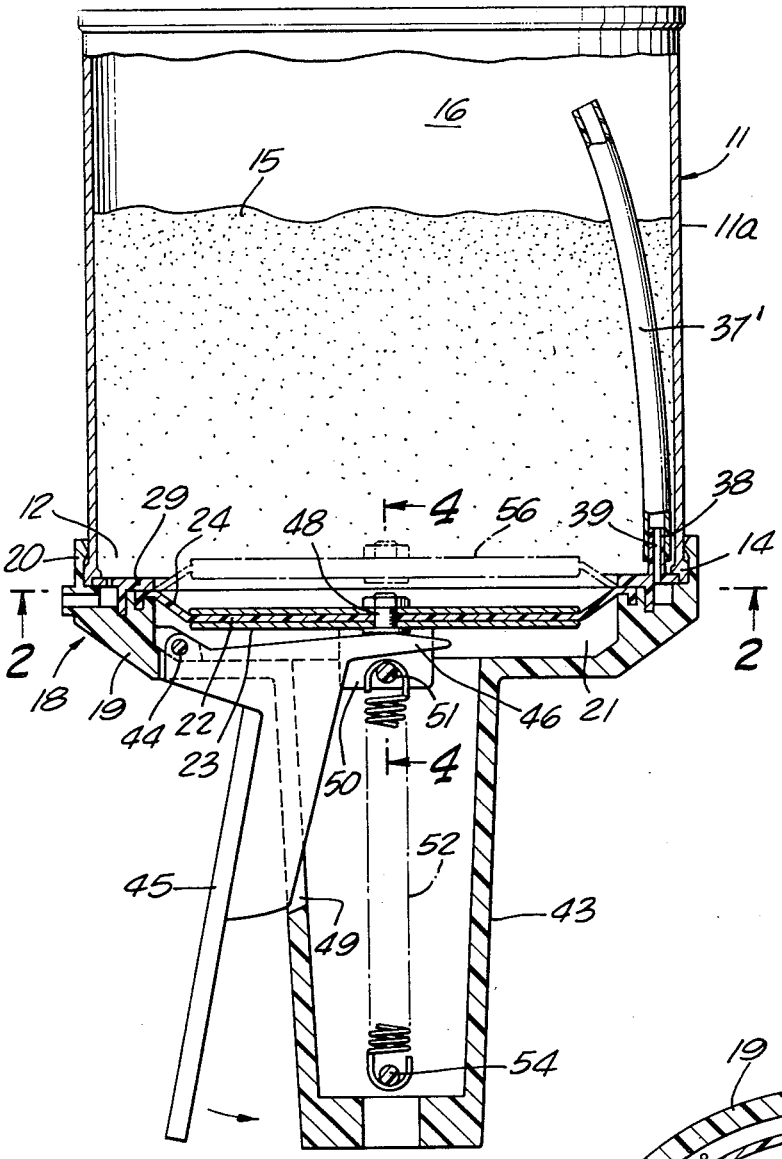
FIG. 1 is a vertical cross-section view.

Referring to the drawings, the numeral 11 is a container which consists of an ordinary can which preferably has a top end wall, a cylindrical wall 11*a*, the cylindrical wall being open at its lower end as indicated at 12, and also being provided with an annular flange 14.

The container 11 is adapted to contain powder 15 to be dispersed and it is preferred to have the can or container 11 only partly filled so that there will be an air chamber 16 in the upper part of the container.

The numeral 18 represents a body having a base portion 19 provided with an upstanding annular wall 20 which receives the bead 14 of the cylindrical wall 11.

The body 18 is made from plastic material and, therefore, the body and can are assembled by snapping the two parts into place.

It is to be understood that when the can and body are being assembled the can is positioned with its open end up and no powder will be spilled.

The base 19 provides a diaphragm chamber 21 and positioned in this chamber is a movable wall in the form of a diaphragm 22, the central portion of which is supported by discs 23 and the annular portion is left unsupported and is flexible.

Figure 3:
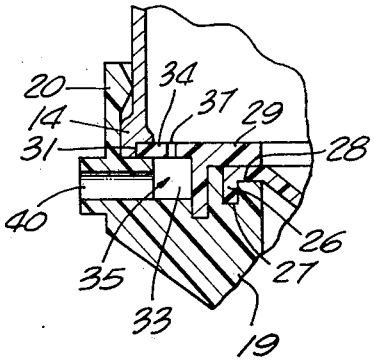
FIG. 3 is an enlarged fragmentary sectional view showing the manner in which the container, the body, and the diaphragm are secured together.
Figure 4:
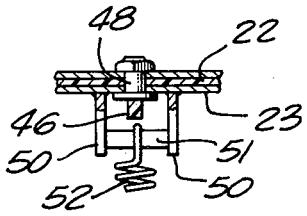
FIG. 4 is a fragmentary sectional view taken on line 4—4 of FIG. 1 showing the manner in which a spring is attached to the diaphragm.
Figure 2:
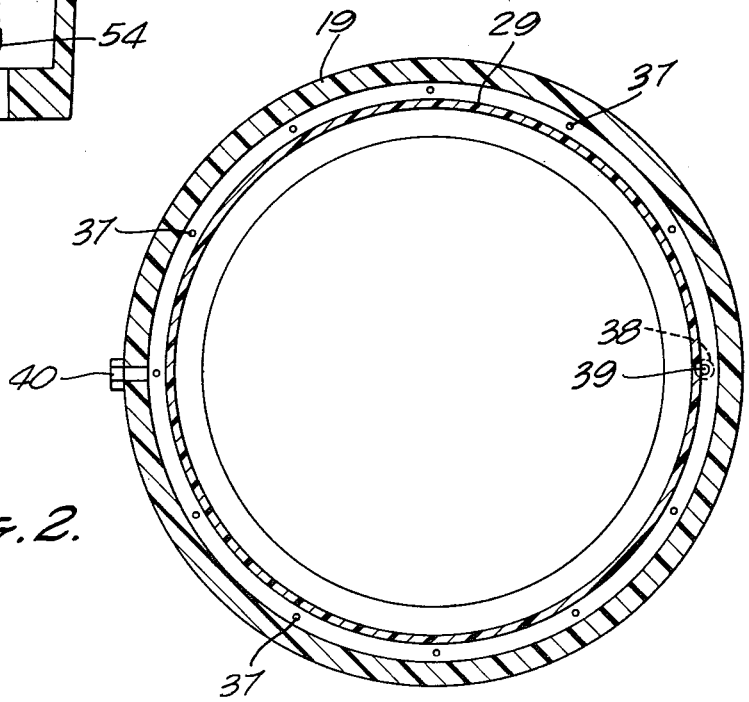
FIG. 2 is a view taken along line 2—2 of FIG. 1.

The outer annular portion 24 of the diaphragm has a depending lip 26 which extends into an annular groove 27 of the body 19 and the diaphragm is held against the annular wall 28, as best shown in the enlarged view, FIG. 3, by means of a hold-down ring 29. The hold-down ring 29 is, in turn, held in place by the flange 14 of the container 11, which flange 14 has a receiving recess 31 in which the outer annular portion of the hold-down ring 29 is received.

The body is provided with an annular channel 33 and the top of this channel 33 is closed by the outer annular portion 34 of the hold-down ring 29. These two parts cooperate to provide an outlet chamber in the form of an annular outlet channel 35 which is connected to the lower end of the space in the container by venturi openings 37. There is a communication member in the form of a tube 37' supported by the nipple 38 of the hold-down ring, the tube 37 forming a connection between the space 16 of the container 11 and the opening 39 in the nipple which communicates with the annular outlet channel. The annular outlet channel, at a position opposite from the inlet opening to the channel is provided with an outlet opening or discharge nozzle 40 through which air carrying powder is discharged.

The body also has a handle 43 which projects from the base 18, this handle serving as a means for holding the device in a desired position when in operation.

Pivotally connected to the base 18 by a pivot pin 44 is an operating lever 45 having an arm 46 which engages the central connecting screw 48 which holds the parts of the diaphragm assembly together. The handle has a slot 49 through which the operating lever extends. The lower support plate 23 has depending walls 50 which support a pin 51 to which the upper end of a spring 52 is connected, the lower end of the spring being connected to the handle 43 by means of a lower pin 54. This spring exerts a pull on the diaphragm or movable wall in a direction away from the end of the container 11 thus holding the diaphragm in its full line position, as shown in FIG. 1. The diaphragm is moved into its broken line position 56 of FIG. 1 by squeezing the operating lever 45 toward the handle 43.

The operation of the invention is as follows: With the parts assembled, as shown, and with powder contained in the container 11, an air dust dispersion is discharged from the outlet passage 40 by squeezing the lever toward the handle. This is done rather sharply and the action which takes place is, of course, the upward movement of the diaphragm. This agitates the powder at the lower end of the can and this agitation extends over the annular channel and in the area of the venturi openings 37. Also the upward movement of the diaphragm 56 reduces the volume of the inside of the container and causes air to flow through the tube 37', the nipple 38 and into and through the annular channel 35. Air flowing through the annular channel 35 causes a venturi action which sucks powder through the openings 37 and the powder is discharged with the air through the air discharge nozzle 40. By having a plurality of small venturi passages the dispersion of the powder is very uniform and the dispersion which is discharged will provide even dust covering on the vegetation which is being dusted.

We claim:

1. A powder dispersing device comprising the combination of:

(a) a container having an open end for containing a powder to be dispersed;

(b) a body having a base connectable with the open end of said container, said body having a diaphragm chamber;

(c) an annular outlet channel positioned around said diaphragm chamber;

(d) a diaphragm positioned in said diaphragm chamber and closing the end of said container, said diaphragm being movable toward and away from said container thus decreasing and increasing the volume of said container and also agitating the powder in said container adjacent to said diaphragm;

(e) a communication passage connecting said annular channel to the upper portion of said container;

(f) venturi openings connecting said annular channel to the lower end of said container, the powder in the lower portion of said container being drawn by venturi action into said channel when the air from the upper portion of said container moves through said annular outlet channel;

(g) an outlet passage connected to said annular channel and through which air flows carrying with it the powder which has moved into said channel;

(h) a handle forming a part of said body and extending from said base for holding said dispersing device in a desired position; and (i) operating means including a lever for manually moving said diaphragm back and forth, toward and away from said container.

2. A combination as defined in claim 1, in which said container has a shoulder surrounding said open end, and said base has an upstanding wall for coacting with said shoulder to releasably retain the container and body in connected relation.

3. A combination as defined in claim 1, in which said lever is operatively connected with said diaphragm for movement thereof in a direction to decrease the volume of said container; a tension spring in said body is connected with said diaphragm for urging it in a direction to increase the volume of said container.

4. A combination as defined in claim 3, in which said spring is housed within said handle forming part of body.

5. A powder dispersing device comprising the combination of:

(a) a container containing a powder to be dispersed;

(b) a movable wall connected with an open outlet end of said container and being movable toward and away from said container whereby the volume of said container is decreased and increased;

(c) an outlet chamber;

(d) communication means connecting said outlet chamber to the interior of said container independently of said movable wall whereby when said movable wall is moved toward said container air will flow from said container through said communication means and through said outlet chamber;

(e) means including openings connecting said chamber with the open end of said container, said powder moving through said openings and into said chamber when air is forced through said chamber;

(f) an outlet from said chamber through which air flows carrying with it the powder which has moved into said chamber; and (g) means for moving said movable wall.

6. A combination as defined in claim 5, in which said movable wall is centrally positioned at the outlet end of said container and in which said outlet chamber is positioned adjacent to said movable wall.

7. A combination as defined in claim 6, in which said movable wall is a centrally disposed diaphragm which closes the outlet end of said container, and in which said chamber is an annular channel surrounding said diaphragm.

8. A combination as defined in claim 7, including a hold-down ring held in place by the outlet end of said container, said hold-down ring holding and sealing the annular flexible portion of said diaphragm in order to close the outlet end of said container, said hold-down ring also forming a wall of said channel in which said openings are positioned.

* * * * *